US006059904A

United States Patent [19]

Benz et al.

[11] Patent Number: 6,059,904

[45] **Date of Patent: *May 9, 2000**

[54] ISOTHERMAL AND HIGH RETAINED STRAIN FORGING OF NI-BASE SUPERALLOYS

[75] Inventors: Mark Gilbert Benz, Burnt Hills; Michael Francis Henry; Charles Philip Blankenship, Jr., both of Niskayuna; Aldo Enrique Murut, Schenectady, all of N.Y.

[73] Assignee: General Electric Company, Schenectady, N.Y.

[ * ] Notice: This patent is subject to a terminal disclaimer.

[21] Appl. No.: 08/862,448

[22] Filed: May 23, 1997

Related U.S. Application Data

[63] Continuation of application No. 08/430,007, Apr. 27, 1995, abandoned.

[51] Int. Cl.[7] ..... C22F 1/10; B22F 3/00

[52] U.S. Cl. ..... 148/676; 148/677; 419/28; 419/29; 419/32; 72/709; 72/342.5; 72/356

[58] Field of Search ..... 148/675, 676, 148/677, 564; 419/28, 29, 32; 72/709, 342.5, 356

[56] References Cited

U.S. PATENT DOCUMENTS

| | | | |
|---|---|---|---|
| 4,579,602 | 4/1986 | Paulonis et al. | 148/677 |
| 4,685,977 | 8/1987 | Chang | 148/410 |
| 4,957,567 | 9/1990 | Krueger et al. | 148/677 |
| 5,061,324 | 10/1991 | Chang | 148/677 |
| 5,080,734 | 1/1992 | Krueger et al. | 419/29 |
| 5,120,373 | 6/1992 | Miller et al. | 148/676 |
| 5,393,483 | 2/1995 | Chang | 148/410 |
| 5,413,752 | 5/1995 | Kissinger et al. | 419/28 |
| 5,649,280 | 7/1997 | Blankenship et al. | 419/54 |

FOREIGN PATENT DOCUMENTS

| | | |
|---|---|---|
| 05163505 | 6/1993 | Japan . |
| 92018659 | 10/1992 | WIPO . |

OTHER PUBLICATIONS

ASM Handbook vol. 14 pp. 261–266, Apr. 1988.

"Isocon Manufacturing of Waspaloy Turbine Discs", Douglas P. Stewart, Ladish Co., Inc. Cudahy, WI, pp. 545–551 1989.

*Primary Examiner*—Margery Phipps

*Attorney, Agent, or Firm*—Ernest G. Cusick; Noreen C. Johnson

[57] ABSTRACT

A method combining isothermal and high retained strain forging is described for Ni-base superalloys, particularly those which comprise a mixture of γ and γ' phases, and most particularly those which contain at least about 40 percent by volume of γ'. The method permits the manufacture of forged articles having a fine grain size in the range of 20 μm or less. The method comprises the selection of a fine-grained forging preform formed from a Ni-base superalloy, isothermal forging to develop the shape of the forged article, subsolvus forging to impart a sufficient level of retained strain to the forged article to promote subsequent recrystallization and avoid critical grain growth, and annealing to recrystallize the microstructure. The method permits the forging of relatively complex shapes and avoids the problem of critical grain growth. The method may also be used to produce location specific grain sizes and phase distributions within the forged article.

28 Claims, 6 Drawing Sheets

ISOTHERMAL AND HIGH RETAINED STRAIN FORGING OF NI-BASE SUPERALLOYS

This application is a Continuation of application Ser. No. 08/430,007, filed Apr. 27, 1995, now abandoned.

FIELD OF THE INVENTION

This invention is generally directed to a method for forging Ni-base superalloy articles so as to impart sufficient retained strain to them to provide a basis for subsequent recrystallization and the creation of a substantially uniform, fine grain size microstructure. Specifically, the method combines isothermal and high retained strain forging of Ni-base superalloys below their γ' solvus temperatures to produce forged articles having a minimum level of retained strain to promote subsequent recrystallization of a uniform, fine grain size microstructure. Forging is followed by annealing of the forged article to recrystallize the microstructure. Annealing may be done in a range of temperatures that includes temperatures both above and below the γ' solvus temperature.

BACKGROUND OF THE INVENTION

Advanced Ni-base superalloys are currently isothermally forged 60 at relatively slow strain rates and temperatures below their γ' solvus temperatures. Forging 60 is typically followed by a combination of subsolvus and supersolvus annealing 70 as illustrated in FIG. 1, and may be combined with controlled cooling 75. This method utilizes the superplastic deformation of Ni-base superalloys and tends to minimize forging loads and die stresses, and avoids fracturing the items being formed during forging operations. The superplastic deformation is of particular benefit in that it permits more complex shapes to be forged, it also permits the retained metallurgical strain in the forging at the conclusion of the forming operations to be minimized. However, this method can have substantial limitations with respect to forming substantially uniform fine grain size articles. While the method tends to produce relatively fine-grain as-forged microstructures having an average grain size on the order of about 7 μm, subsequent supersolvus annealing causes the grain size to increase to about 20–30 μm. Also, unless the forging process is carefully controlled so as to avoid imparting retained strain into the forged articles, this method can produce articles that are subject to the problem of critical grain growth, wherein the retained strain energy in the article can cause limited nucleation and substantial growth (in regions containing the retained strain) of very large grains upon subsequent supersolvus annealing. Critical grain growth can cause the formation of grains as large as 300–3000 μM.

Also, in advanced applications such as turbine disks, it may be desirable to have location specific properties within a given article, such as a finer grain size in the bore for enhanced low temperature strength and low cycle fatigue (LCF) resistance; coupled with a larger grain size in the rim for crack propagation resistance and high temperature creep resistance. The related art forging method described above also has not been shown to be suitable for producing such location specific properties.

Therefore, new methods of forging are desirable that retain the benefits of isothermal forging, such as the use of superplastic deformation to form more complex shapes, and yet also produce forged articles that avoid critical grain growth. It is also desirable that such new methods that enable the development of location specific alloy properties.

SUMMARY OF THE INVENTION

This invention describes a method combining isothermal and high retained strain forging of Ni-base superalloys below their γ' solvus temperatures, followed by annealing and optionally, controlled cooling of the annealed alloys. Forging in the manner described causes significant strain energy to be retained throughout the forged article, sufficient energy to promote the substantially uniform subsequent recrystallization of γ grains throughout the forged microstructure. Such recrystallization occurs during annealing of the forged articles. Controlled cooling after supersolvus annealing is used to control the morphology and distribution of the γ' phase within the forged and annealed articles. The result is a fine-grained microstructure within the forged articles. Characteristically, these grain sizes range from about 10–20 μm.

The present invention is a method of forging an article having a controlled grain size from a Ni-base superalloy, comprising the steps of: selecting a forging preform formed from a Ni-base superalloy and having a microstructure comprising a mixture of γ and γ' phases, wherein the γ' phase occupies at least 40% by volume of the Ni-base superalloy; forging the forging preform at a first temperature in the range of about 0–100 F.° below a γ' solvus temperature ($T_S$) of the Ni-base superalloy at a first strain rate of 0.01 $s^{-1}$ or less for a first time sufficient to superplastically form the forging preform into a forged article; forging the forged article at a second subsolvus temperature and a second strain rate for a second time sufficient to re-form the forged article and store a minimum amount of retained strain energy per unit of volume throughout the forged article; and annealing the article at an annealing temperature ($T_A$) in the range $(T_S-100) \leqq T_A \leqq (T_S+100)$, where $T_A$ and $T_S$ are in Fahrenheit degrees, for a time sufficient to ensure that substantially all of the forged article is raised to the annealing temperature, wherein the minimum amount of retained strain energy per unit of volume stored during forging is sufficient to promote recrystallization throughout the forged article during said annealing.

The method also may comprise the step of cooling the article to a temperature lower than the γ' solvus temperature at a controlled cooling rate immediately after the step of supersolvus annealing.

The method described herein is particularly suited for use with fine-grained Ni-base superalloy preforms containing γ and γ' as described above, such as those formed by hot-extruding the preform from superalloy powders.

One object of the method of the present invention is to produce a forged article from Ni-base superalloys having sufficient retained strain energy per unit of volume throughout to promote substantially uniform subsequent recrystallization of substantially all of the alloy microstructure.

A second object is to produce a forged and annealed article from Ni-base superalloys having a fine recrystallized grain size, in the range of about 10–20 μm.

A third object is to control the distribution of γ' both within and between the γ grains, and particularly to produce fine γ' particles within the γ grains and γ' along the grain boundaries.

A significant advantage of the method of the present invention is that it avoids the problem of critical grain growth.

Another possible advantage of the method of the present invention, is that it provides a method of making fine grain size Ni-base superalloys using the same supersolvus annealing step as is used to make large grain size Ni-base superalloys as described in the method incorporated by reference herein, and thus may be compatible for use in conjunction with this method. Therefore, Applicants believe that it is possible to develop different location specific grain sizes, and hence properties, within a single forged article.

The foregoing objects, features and advantages of the present invention may be better understood in view of the description contained herein, particularly the following drawings and specification.

DETAILED DESCRIPTION OF THE INVENTION

Figure 1:
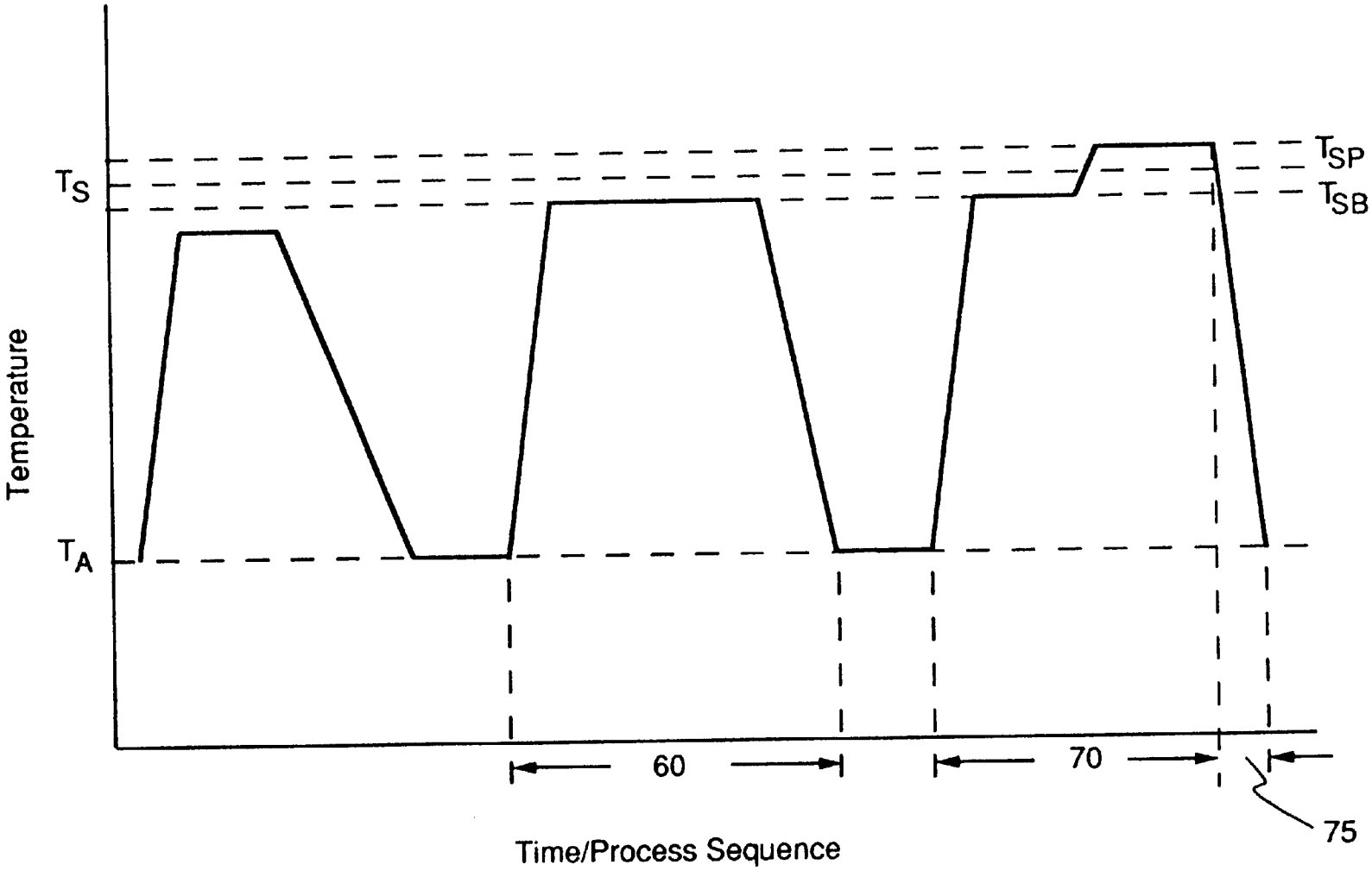
FIG. 1 is a schematic illustration of a related art method for forging fine grain size Ni-base superalloys.

Applicants have invented a method which combines isothermal forging and subsolvus forging to develop specific levels of retained strain which may be utilized to produce relatively complex forged articles from Ni-base superalloys having a substantially-uniform, fine grain size on the order of about 10–20 $\mu$m. The method utilizes forging and subsolvus annealing, supersolvus annealing or both to recrystallize the microstructure and form the fine grain size. The recrystallization is caused by imparting a minimum level of retained strain per unit of volume throughout the article during the forging operation.

The method of this invention is related to a method of retained strain forging described in co-pending patent application Ser. No. 08/298,862, filed on Aug. 31, 1994, now abandoned, which is herein incorporated by reference.

The method of this invention may be described as a method of forging an article having a controlled grain size from a Ni-base superalloy, comprising the steps of: forming 80 or selecting 85 a forging preform formed from a Ni-base superalloy and having a microstructure comprising a mixture of $\gamma$ and $\gamma'$ phases, wherein the $\gamma'$ phase occupies at least 40% by volume of the Ni-base superalloy; forging 88 the forging preform at a first temperature in the range of about 0–100 F.° below a $\gamma'$ solvus temperature ($T_S$) of the Ni-base superalloy at a first strain rate of 0.01 $s^{-1}$ or less for a first time sufficient to superplastically form the forging preform into a forged article; forging 90 the forged article at a second subsolvus temperature and a second strain rate for a second time sufficient to re-form the forged article and store a minimum amount of retained strain energy per unit of volume throughout the forged article; and annealing 100 the article at an annealing temperature ($T_A$) in the range $(T_S-100) \leqq T_A \leqq (T_S+100)$, where $T_A$ and $T_S$ are in Fahrenheit degrees, for a time sufficient to ensure that substantially all of the forged article is raised to the annealing temperature, wherein the minimum amount of retained strain energy per unit of volume stored during forging is sufficient to promote recrystallization throughout the forged article during said annealing.

Figure 2:
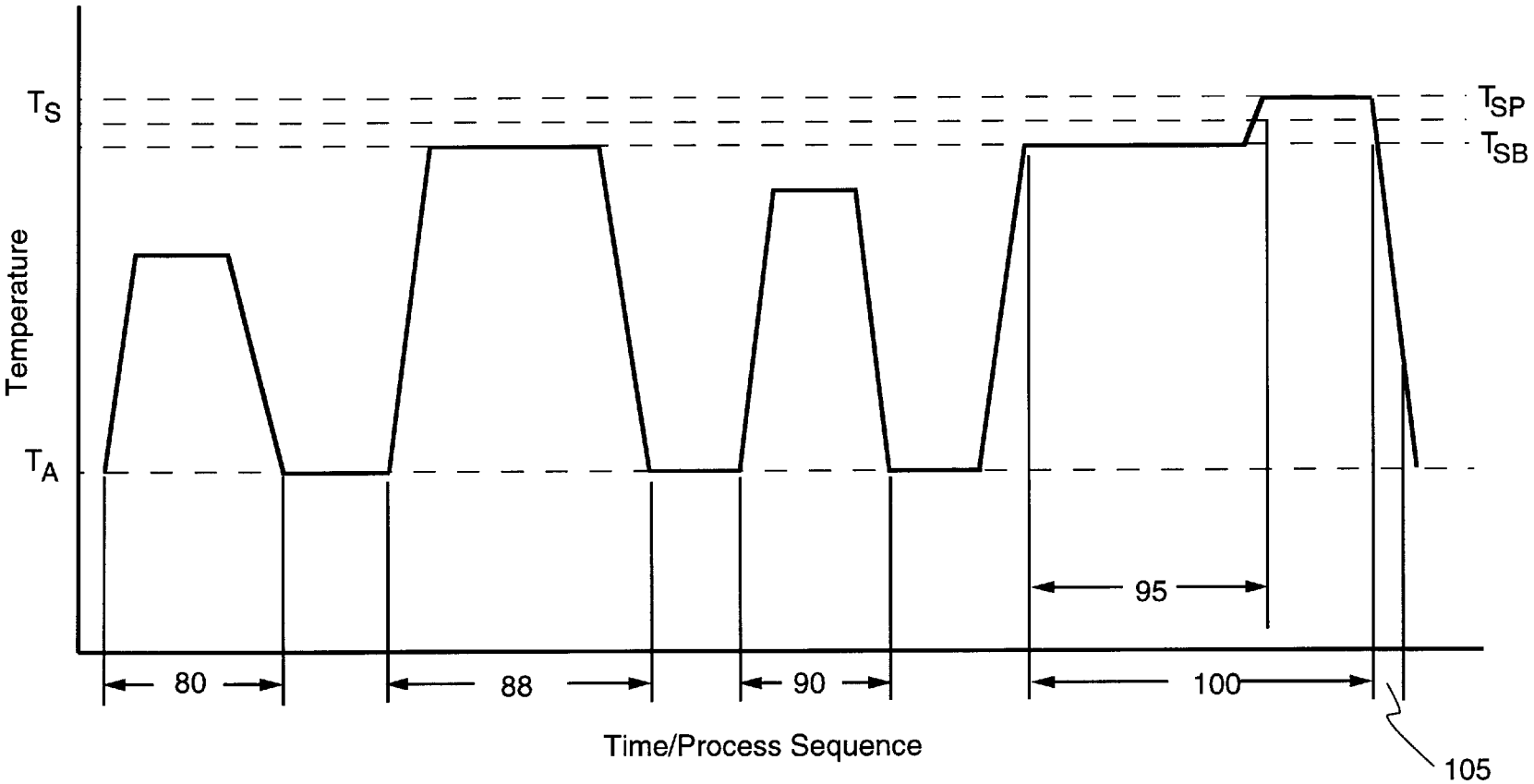
FIG. 2 is a schematic representation of a method of forging of the present invention.

FIG. 2 is a schematic representation of a preferred embodiment of the method or process of the present invention. FIG. 2 illustrates the process temperature as a function of the process sequences, as well as particular time intervals within some of the process sequences. The process begins with the step of forming a forging preform 80. A forging preform (not illustrated) may be of any desired size or shape that serves as a suitable preform, so long as it possesses characteristics that are compatible with being formed into a forged article, as described further below. The preform may be formed 80 by any number of well-known techniques, however, the finished forging preform should have a relatively fine grain size within the range of about 1–50 $\mu$m. In a preferred embodiment, the forming 80 of the forging preform is accomplished by hot-extruding a Ni-base superalloy powder, such as by extruding the powder at a temperature sufficient to consolidate the particular alloy powder into a billet, blank die compacting the billet into the desired shape and size, and then hot-extruding to form the forging preform. For Rene'88 powder, the hot-extrusion was performed at a temperature of about 1950° F. Preforms formed by hot-extrusion typically have a grain size on the order of 1–5 $\mu$m. Another method for forming preforms may comprise the use of spray-forming, since articles formed in this manner also characteristically have a grain size on the order of about 20–50 $\mu$m.

Applicants believe that the method of this invention may be applied generally to Ni-base superalloys comprising a mixture of $\gamma$ and $\gamma'$ phases. Such Ni-base superalloys are well-known. Representative examples of these alloys, including compositional and mechanical property data may be found in references such as Metals Handbook (Tenth Edition), Volume 1 Properties and Selection: Irons, Steels and High-Performance Alloys, ASM International (1990), pp. 950–1006. The method of the present invention is particularly applicable and preferred for use with Ni-base superalloys that have a microstructure comprising a mixture of both $\gamma$ and $\gamma'$ phases where the amount of the $\gamma'$ phase present at ambient temperature is about 40 percent or more by volume. These $\gamma/\gamma'$ alloys typically have a microstructure comprising $\gamma$ phase grains, with a distribution of $\gamma'$ particles both within the grains and at the grain boundaries, where some of the particles typically form a serrated morphology that extends into the $\gamma$ grains. The distribution of the $\gamma'$ phase depending largely on the thermal processing of the alloy. Table 1 illustrates a representative group of Ni-base superalloys for which the method of the present invention may be used and their compositions in weight percent. These alloys may be described as alloys having compositions in the range 8–15 Co,10–19.5 Cr, 3–5.25 Mo, 0–4 W, 1.4–5.5 Al, 2.5–5 Ti, 0–3.5 Nb, 0–3.5 Fe, 0–1 Y, 0–0.07 Zr, 0.04–0.18 C, 0.006–0.03 B and a balance of Ni, in weight percent. However, Applicants believe that other alloy compositions comprising the mixture of $\gamma$ and $\gamma'$ phases described above are also possible. Applicants further believe that this may include Ni-base superalloys that also include small amounts of other phases, such as the $\delta$ or Laves phase, in addition to a mixture of $\gamma$ and $\gamma'$ phases. A Ni-base superalloy of the present invention is also described in U.S. Pat. No. 4,957,567, which is herein incorporated by reference. This alloy has a composition in the range of 12–14 Co, 15–17 Cr, 3.5–4.5 Mo,3.5–4.5 W, 1.5–2.5 Al, 3.2–4.2 Ti, 0.5–1.0 Nb, 0.01–0.06 Zr, 0.01–0.06 C, 0.01–0.04 B, up to 0.01 V, up to 0.3 Hf, up to 0.01 Y, and a balance of Ni excepting incidental impurities, in weight percent, which also comprehends the composition of Rene'88 as set forth herein.

However, the method of the present invention does not require the forming 80 of an alloy preform. It is sufficient as a first step of the method of the present invention to merely select 85 a Ni-base superalloy preform having the characteristics described above. The selection 85 of forging preform shapes and sizes in order to provide a shape that is suitable for forging into a finished or semifinished article is well known.

TABLE 1

| | Alloy | | | | | |
|---|---|---|---|---|---|---|
| Element | Rene'88 | Rene'95 | IN-100 | U720 | Waspaloy | Astroloy |
| Co | 13 | 8 | 15 | 14.7 | 13.5 | 15 |
| Cr | 16 | 14 | 10 | 18 | 19.5 | 15 |
| Mo | 4 | 3.5 | 3 | 3 | 4.3 | 5.25 |
| W | 4 | 3.5 | 0 | 1.25 | 0 | 0 |
| Al | 1.7 | 3.5 | 5.5 | 2.5 | 1.4 | 4.4 |
| Ti | 3.4 | 2.5 | 4.7 | 5 | 3 | 3.5 |
| Ta | 0 | 0 | 0 | 0 | 0 | 0 |
| Nb | 0.7 | 3.5 | 0 | 0 | 0 | 0 |
| Fe | 0 | 0 | 0 | 0 | 0 | 0.35 |
| Hf | 0 | 0 | 0 | 0 | 0 | 0 |
| Y | 0 | 0 | 1 | 0 | 0 | 0 |
| Zr | 0.05 | 0.05 | 0.06 | 0.03 | 0.07 | 0 |
| C | 0.05 | 0.07 | 0.18 | 0.04 | 0.07 | 0.06 |
| B | 0.015 | 0.01 | 0.014 | 0.03 | 0.006 | 0.03 |
| Ni | bal. | bal. | bal. | bal. | bal. | bal. |

Referring again to FIG. 2, after forming 80 or selecting 85 a Ni-base superalloy preform, the next step in the method is the step of forging 88 the preform into a forged article (not shown). Forging 88 comprises isothermal subsolvus forging, with a principal purpose being the establishment of the shape of the forged article. Methods and apparatuses for subsolvus isothermal forging of Ni-base superalloys are well-known. Isothermal forging is typically performed in the range of 0–100 F.° below the γ' solvus temperature, at relatively slow strain rates on the order of 0.01 $s^{-1}$ or less, and for a time sufficient to form the desired shape of the forged article. The temperature, strain rate and forging time referred to with respect to forging 88 are referred to herein as the first subsolvus temperature, first strain rate and first time. This step is particularly useful and advantageous because it permits the preform to be formed into more complex shapes than may be formed in the subsequent forging 90 that is intended to impart retained strain into the forged article, because forging 88 employs super plastic deformation of the Ni-base alloy.

Forging 88 then generally comprises: heating the forged article to the forging temperature, forging the forged article within the temperature and strain rate conditions described above, and cooling of the forged article, generally to ambient temperature, however, it would be possible to transition directly to the next step without cooling to ambient temperature.

Following forging 88, the next step is the step of forging 90. Forging 90 is done to impart a minimum level of retained strain energy into the forged article to promote subsequent recrystallization throughout the forged article. Forging 90 must be done at a temperature, strain rate and time sufficient to store the required minimum retained strain and re-form the forged article into the shape desired as the output of the method of this invention. Forging 90 is done at a subsolvus temperature with respect to the selected 85 Ni-base superalloy. It is preferred that the subsolvus forging temperature be in the range of about 0–600° F. below the solvus temperature of the selected superalloy, depending on the strain rate employed, however, lower temperatures, including ambient temperature, may be employed. Applicants have determined that it is preferred that the strain rates used for the step of forging 90 should be relatively higher than the strain rates used for forging 88, in the range of about 0.01 $s^{-1}$ or greater, however, slower strain rates may be employed depending again on the forging 90 temperature that is utilized. At the lower temperature end of the range, the strain rate must be selected so as to not create excessive die stresses or cause the fracture of the forged article. At temperatures near $T_S$, the strain rate must be high enough to achieve a minimum amount of retained strain, as described further below. The forging 90 time should be sufficient to re-form the forged article and impart the necessary minimum level of retained strain energy. Forging 90 may be performed using ordinary means for forging Ni-base superalloys, such as hot die forging, hammer forging or other forging methods. The temperature, strain rate and forging time referred to with respect to forging 90 are referred to herein as the second subsolvus temperature, second strain rate and second time.

Forging 90 then generally comprises: heating the forged article to the forging temperature, forging the preform within the temperature and strain rate conditions described above, and cooling of the forged article, generally to ambient temperature, however, it would be possible to transition directly to the next step without cooling to ambient temperature.

Applicants have determined that in order to obtain the recrystallization of substantially all of the microstructure of the forged article and form a substantially-uniform, fine grain size, that it is necessary to impart a minimum level of retained strain energy into the forged article during forging 90. This retained strain or strain energy serves as the driving force for nucleation of recrystallized grains. Therefore, this minimum strain energy should be distributed throughout the microstructure, such that the minimum retained strain should be on a per unit of volume basis. The retained strain energy must achieve a minimum level throughout the article in order to avoid the problem of critical grain growth which is caused by having regions within an article with levels of retained strain below the threshold, such that grain growth is initiated, but not bounded by other adjacent nucleating grains. While it is difficult to measure the absolute threshold of retained strain energy necessary, this energy must be maintained so as to provide sufficient nucleation sites for recrystallization, at the supersolvus annealing conditions described further below, to limit grain growth to about 20 μm or less, preferably in a range between about 10–20 μm. Applicants have measured an equivalent of the retained strain energy, the percentage of room temperature reduction in height, as a function of the recrystallized grain size for Rene'88. In this test, regularly shaped specimens were compressed at room temperature to produce varying degrees of reduction in height (i.e. varying levels of retained strain energy, since almost all of the strain energy is stored in the compressed articles at room temperature). After supersolvus annealing, the grain size was measured for each of the specimens. The results indicate that the threshold as measured using this method was about 6% reduction in height. Between about 1–6% reduction in height, critical grain growth was observed, producing grains up to about 300 μm. These experiments are described further below. Similar results have been observed for the Ni-base superalloy Rene'95, and are expected for other Ni-base superalloys.

High strain rates are employed in order to impart sufficient retained strain energy as described above, and overcome the effects of dynamic recrystallization that would naturally tend to occur at the higher forging temperatures described herein, such that controlled recrystallization may be employed to exert more exacting grain size control.

Figure 4:
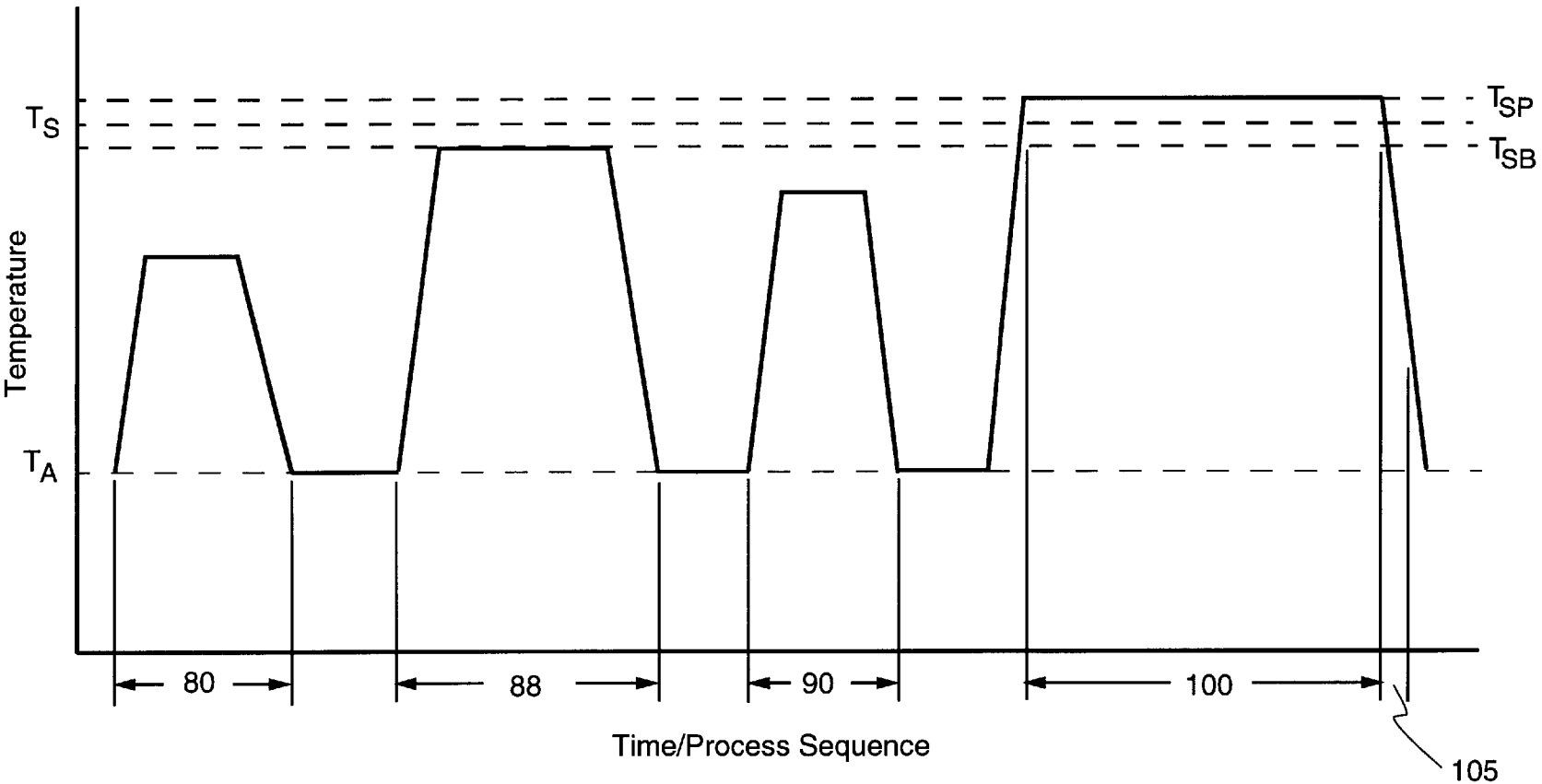
FIG. 4 is a schematic representation of a second embodiment of the method of forging of the present invention.
Figure 5:
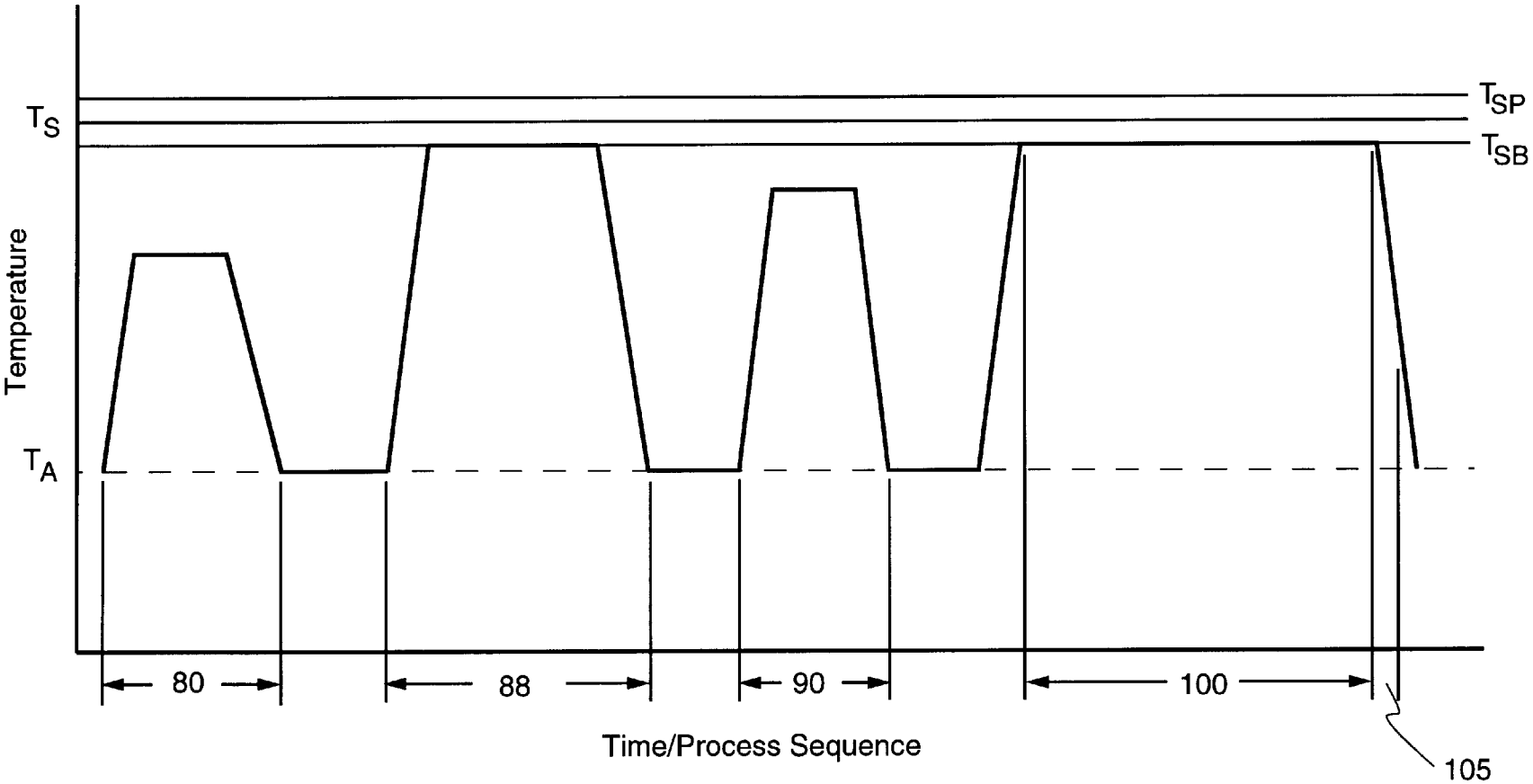
FIG. 5 is a schematic representation of a third embodiment of the method of forging of the present invention.

In the method of the invention, referring again to FIG. 2, it is necessary to utilize an additional step of annealing 100 in order to recrystallize the microstructure and produce the desired fine-grain microstructure. Annealing 100 may be done at either supersolvus (see FIG. 4) or subsolvus (see FIG. 5) temperatures. Applicants believe that the preferred range of temperatures for annealing 100 can be represented as $(T_S-100)\leqq T_A\leqq(T_S+100)$, where $T_A$ is the annealing temperature and $T_S$ is the solvus temperature, both in degrees Fahrenheit. Supersolvus annealing dissolves all of the γ' and promotes recrystallization throughout the microstructure. Subsolvus annealing for long times at temperatures just under the γ' solvus temperature dissolves a large volume fraction of the γ' and also promotes recovery and/or recrystallization throughout the microstructure. Grain sizes achieved using supersolvus annealing 100 are about 10–20 μm, while those expected for subsolvus annealing are somewhat smaller, about 7–12 μm. In a preferred embodiment using supersolvus annealing 100, prior to supersolvus annealing 100, the forged article is subjected to subsolvus annealing 95 at a temperature $T_{SB}$, where $T_{SB}$ is in the range of about (0–100 F.°) less than $T_S$. This step serves to ensure that substantially all of the forged article is at a near-solvus temperature prior to exposing the forged article to supersolvus temperatures and the consequent dissolution of the γ'. Such subsolvus annealing 95 is well known. The subsolvus annealing 95 time depends on the thermal mass of the forged article immediately after this step, the forged article is raised to the supersolvus annealing 100 temperature ($T_{SP}$), where $T_{SP}$ is in the range of about 0–100 F.° above $T_S$. The forged article is annealed in the range of about 15 minutes to 5 hours, depending on the thermal mass of the forged article and the time required to ensure that substantially all of the article has been raised to a supersolvus temperature. In addition to preparing the forged article for subsequent cooling to control the γ' phase distribution, this anneal is also believed to contribute to the stabilization of the grain size of the forged article. Both subsolvus annealing and supersolvus annealing may be done using known means for annealing Ni-base superalloys.

Referring again to FIG. 4, supersolvus annealing 100 of the method of the present invention also may be done without previous subsolvus annealing. This embodiment of the method may be desirable for forged articles having a relatively small thermal mass.

Following the step of annealing 100, the cooling 105 of the article may be controlled until the temperature of the entire article is less than $T_S$ in order to control the distribution of the γ' phase. Applicants have observed that in a preferred embodiment, the cooling rate after supersolvus annealing should be in the range of 100–600 F.°/minute so as to produce both fine γ' particles within the γ grains and γ' within the grain boundaries. Typically the cooling is controlled until the temperature of the forged article is about 200–500 F.° less than $T_S$, in order to control the distribution of the γ' phase in the manner described above. Faster cooling rates (e.g. 600 F.°/minute) tend to produce a fine distribution of γ' particles within the γ grains. Slower cooling rates (e.g. 100 F.°/minute) tend to produce fewer and coarser γ' particles within the grains, and a greater amount of γ' along the grain boundaries. Various means for performing such controlled cooling are known, such as the use of air jets or oil quench directed at the locations where cooling control is desired.

Another method for producing location specific properties may be to apply the method of the present invention with the method described in co-pending U.S. patent application Ser. No. 08/271,611, filed on Jul. 7, 1994, which is hereby incorporated by reference, to different areas of a single forged article. This would provide an article having an area or areas of a grain size corresponding to the application of the method of the present invention, as well as an area or areas having a larger grain size, corresponding to the application of the referenced method.

A method for producing location specific properties may involve the use of the method of the present invention on a preform with a plurality of different location specific compositions, such that the γ' solvus temperature would vary at the locations having different compositions, or such that the γ' distribution of the different compositions would vary in the event that the solvus temperatures are similar. This method would be expected to produce either grain size or γ' distribution differences, or both, that would in turn develop location specific alloy properties.

EXAMPLE 1

Forging preforms were selected of a Ni-base superalloy known by the tradename Rene'88, Ni-13Co- 16Cr-4Mo-4W- 1.7Al-3.4Ti-0.7Nb-0.05Zr-0.05C-0.015B in weight percent. The preforms were formed by hot-extruding a powder of this alloy at about 1950° F. The grain size of the preforms was about 1–5 μm.

The preforms were then forged under a variety of temperature ($T_S$)and strain rate conditions as shown in Table 2. The total strain imparted ranged from about 50–70 percent. $T_S$ for Rene'88 is about 2030° F. The supersolvus annealing was performed at 2100° F. for 2 hours.

TABLE 2

Rene'88 Grain Size as a Function of Forging Temperature/Strain Rate (Isothermal Forge + Anneal at 2100° F./2 hrs)

| Temp. | Strain Rate ($s^{-1}$) | |
|---|---|---|
| (° F.) | 0.1 | 0.01 |
| 1500 | | 13 μm |
| 1600 | 11 μm | 11 μm |
| 1700 | 11 μm | 11 μm |
| 1800 | 13 μm | 13 μm |

The resultant grain sizes are averages based on a plurality of grain size measurements made on the individual forged articles. As can be seen, the grain size range of about 11–13 μm can be achieved by the combination of subsolvus forging in the temperature range of about 1500–1800° F. (about 230–530° F. below $T_S$) and strain rate range of about 0.1–0.01 $s^{-1}$. Applicants believe that the ability to forge at higher strain rates would permit the use of a higher forging temperatures also.

Applicants have observed that supersolvus annealing 100 produces forged articles made from Rene'88 having a grain size in the range of about 11–13 μm as measured using the mean linear intercept method as described in ASTM E-112, a standard for making grain size determinations. Applicants expect that forging 90 of other Ni-base superalloys, having somewhat different solvus temperatures, will produce forged articles having grain sizes in the range of about 10–20 μm. Generally, those alloys having higher solvus temperatures are expected to exhibit the larger grain sizes. This result is significant because this range of expected grain sizes roughly corresponds to results obtained using the present subsolvus forging methods described above. This range of grain sizes is known to provide forged articles with enhanced low temperature strength and LCF resistance as compared to articles having a larger grain size. However, while the grain size results are similar to those achieved using present isothermal subsolvus/low strain rate forging methods, the method of the present invention offers substantial improvements with respect to solving the problem of critical grain growth.

Figure 3:
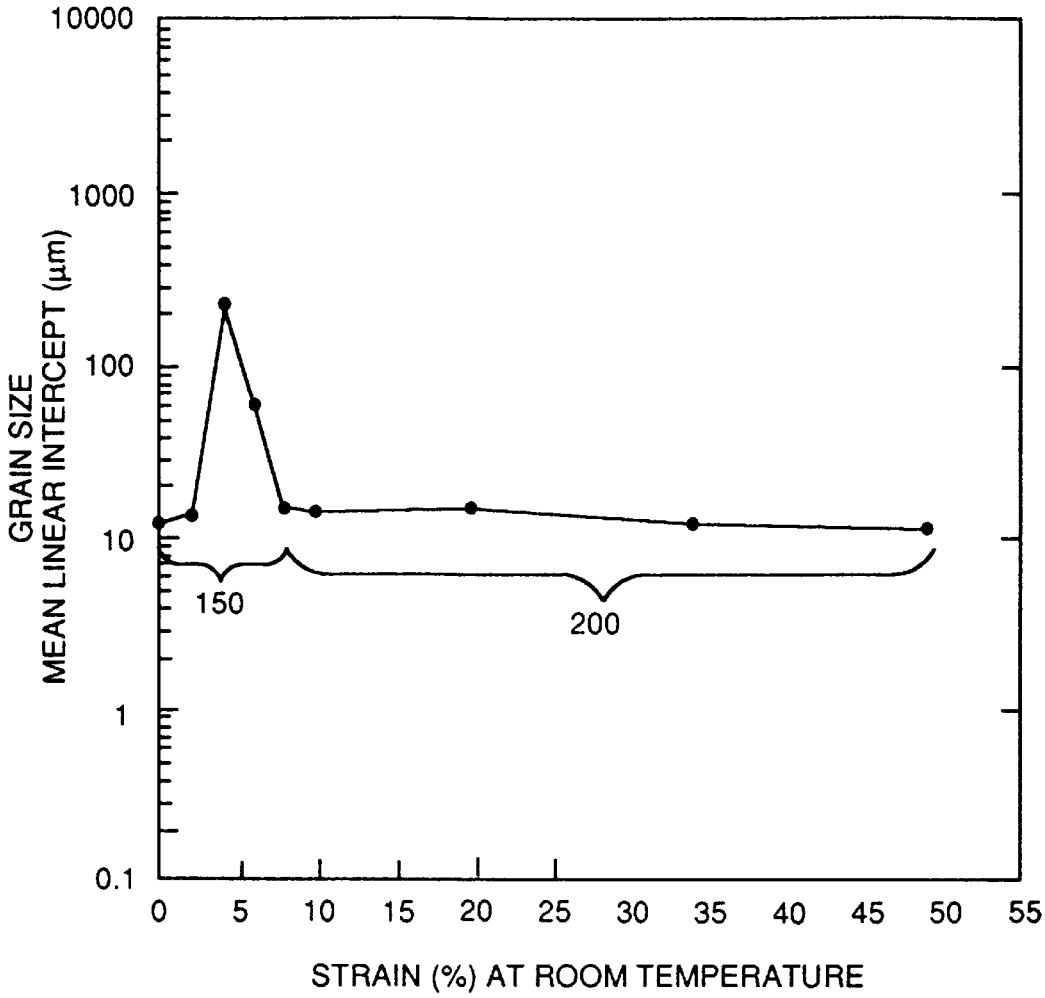
FIG. 3 is a semi-log plot of the recrystallized grain size as a function of measured strain in a Rene'88 alloy after room temperature compression.

Referring now to FIG. 3, Applicants have also measured the grain size of a Ni-base alloy, Rene'88, as a function of varying amounts of retained strain energy. Specimens of Rene'88 were compressed in varying degrees at room temperature, followed by supersolvus heat treatment at 2100° F. for 2 hours. The strain shown in FIG. 3 represents a percentage of reduction in height of the forged specimens, as measured at room temperature. This measure is directly related to the amount of retained strain contained within these specimens, because virtually no recrystallization occurs in this alloy at room temperature. Region 150, representing about 2–6% strain, illustrates the problem of critical grain growth associated with present forging methods. While such methods attempt to minimize retained strain, small amounts of retained strain are known to occur resulting in critical grain growth as shown in region 150. The method of the present invention is illustrated on FIG. 3 by region 200. Region 200 corresponds to specimens having strain levels greater than the threshold of about 6%. It is believed that alloys forged in this region have sufficient retained strain energy to promote substantially uniform recrystallization of substantially all of the alloy microstructure upon subsequent supersolvus heat treatment, resulting in a uniform, fine-grained microstructure with a grain size ranging between 11–13 μm. Therefore, control within an article of the amount of retained strain corresponding to strains within region 200 permits the exercise of a degree of control with respect to the uniformity of the grains and the final grain size. Applicants have observed similar behavior with the Ni-base superalloy Rene'95 in a similar test. Therefore, the method of the present invention offers a substantial improvement in forging Ni-base superalloys by avoiding the problem of critical grain growth associated with present forging methods.

Figure 6:
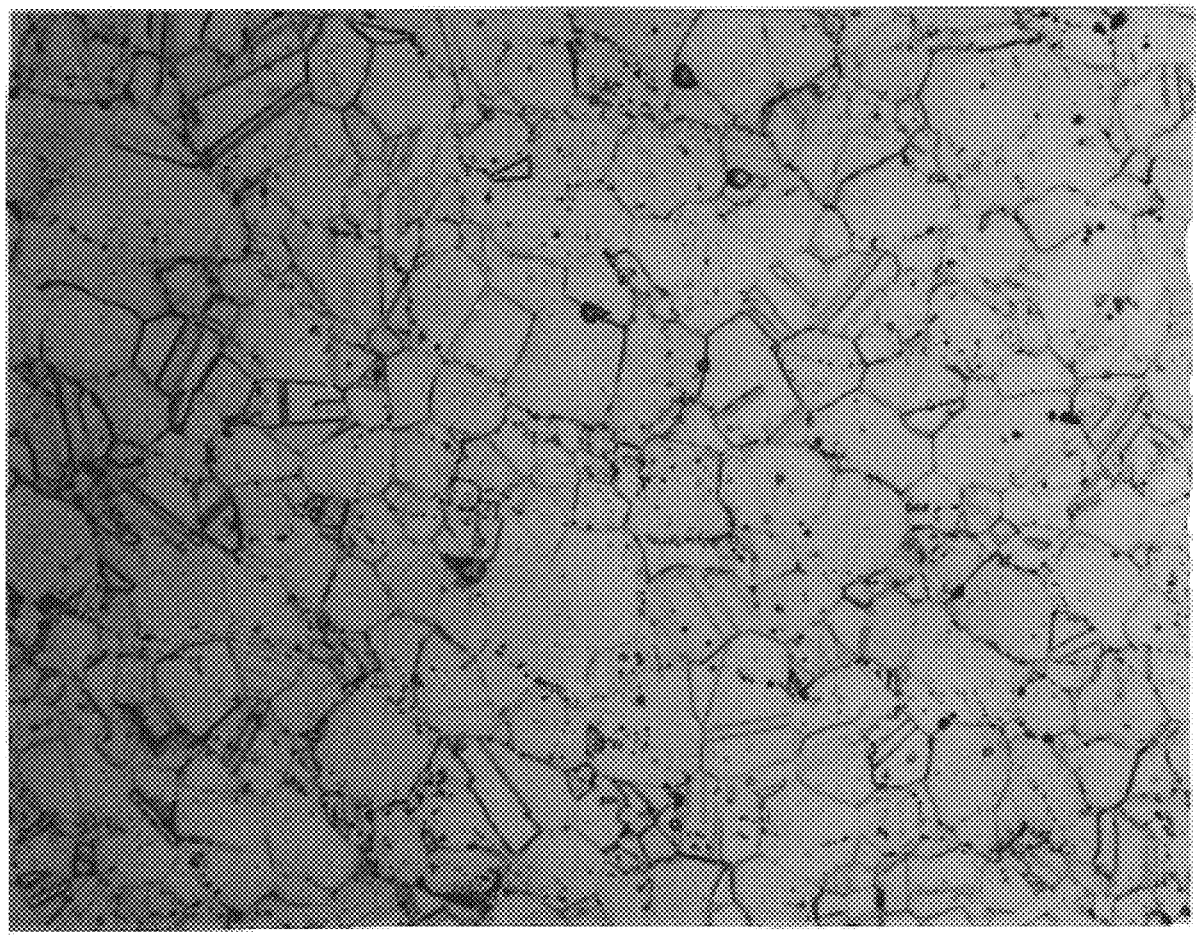
FIG. 6 is an optical photomicrograph illustrating the grain size and morphology of a Rene'88 alloy forged as described herein.

In this example, the cooling rate was not controlled. The resultant etched microstructure of one of the samples is shown in FIG. 6, which is an optical photomicrograph taken at 500X magnification of the sample forged at 1600° F. and a strain rate of 0.1 $s^{-1}$. The surface shown was etched using Walker's reagent, a commonly known etchant for Ni-base superalloys. The microstructure reveals y grains, with some γ' particles present within the grains, but not readily observable at this magnification.

The preceding description and example are intended to be illustrative and not limiting as to the method of the present invention.

What is claimed is:

1. A method of forging an article having a controlled grain size from a Ni-base superalloy, comprising the sequence of the steps of:

selecting a forging preform formed from a Ni-base superalloy and having a microstructure comprising a mixture of γ and γ' phases, wherein the γ' phase occupies at least 40% by volume of the Ni-base superalloy;

forging the forging preform at a first subsolvus temperature in the range of about 0–100 F.° below a γ' solvus temperature $T_S$ of the Ni-base superalloy at a first strain rate of 0.01 $s^{-1}$ or less for a first time sufficient to superplastically form the forging preform into a forged article, wherein during the forging at the first subsolvus temperature a minimum amount of retained strain energy per unit of volume is stored;

forging the forged article at a second subsolvus temperature and a second strain rate for a second time sufficient to re-form the forged article and store a minimum amount of retained strain energy per unit of volume throughout the forged article; and annealing the article at an annealing temperature $T_A$ in the range $(T_S-100) \leqq T_A \leqq (T_S+100)$, where $T_A$ and $T_S$ are in Fahrenheit degrees, for a time sufficient to ensure that substantially all of the forged article is raised to the annealing temperature, wherein the minimum amount of retained strain energy per unit of volume stored during forging is sufficient to promote recrystallization throughout the forged article during said annealing.

2. The method of claim 1, wherein the annealing is a supersolvus annealing and the supersolvus annealing temperature is greater than the γ' solvus temperature.

3. The method of claim 2, further comprising the step of cooling the article to a temperature lower than the γ' solvus temperature at a controlled cooling rate immediately after said supersolvus annealing.

4. The method of claim 3, wherein the controlled cooling rate is in the range of about 100–600 F.°/minute.

5. The method of claim 2, wherein time for the supersolvus annealing is in the range of about 15 minutes to 5 hours.

6. The method of claim 5, wherein a grain size in the forged article after said annealing is in the range of about 20 μm or less.

7. The method of claim 1, wherein a temperature of said annealing is less than or equal to the γ' solvus temperature.

8. The method of claim 7, further comprising the step of cooling the article at a controlled cooling rate immediately after the step of annealing.

9. The method of claim 8, wherein the controlled cooling rate is in the range of about 100–600 F.°/minute.

10. The method of claim 7, wherein a time for the annealing is in the range of about 8 to 168 hours.

11. The method of claim 10, wherein a grain size in the forged article after said annealing is in the range of about 7–12 μm.

12. The method of claim 1, wherein the second temperature is in the range of 0–600 F.° below the γ' solvus temperature of the Ni-base superalloy and the second strain rate is 0.01 $s^{-1}$ or greater.

13. A method of forging an article having a controlled grain size from a Ni-base superalloy, comprising the sequence of the steps of:

selecting a forging preform formed from a Ni-base superalloy and having a microstructure comprising a mixture of γ and γ' phases, wherein the g' phase occupies at least 40% by volume of the Ni-base superalloy;

forging the forging preform at a first subsolvus temperature in the range of about 0–100 F.° below a g' solvus temperature $T_S$ of the Ni-base superalloy at a first strain rate of 0.01 $s^{-1}$ or less for a first time sufficient to superplastically form the forging preform into a forged article;

forging the forged article at a second temperature and a second strain rate for a second time sufficient to re-form the forged article and store a minimum amount of retained strain energy per unit of volume throughout the forged article, wherein a minimum amount of retained strain energy per unit of volume is stored during the forging steps;

subsolvus annealing the article after the step of forging at a subsolvus temperature in the range of about 0–100 F.° below the solvus temperature for a time sufficient to ensure that substantially all of the forged article is at the subsolvus temperature; and supersolvus annealing the article at a supersolvus temperature in the range of about 0–100 F.° above the solvus temperature for a time sufficient to ensure that substantially all of the forged article is raised to the supersolvus temperature, wherein the minimum amount of retained strain energy per unit of volume stored during forging is sufficient to promote recrystallization throughout the forged article upon supersolvus annealing.

14. The method of claim 13, further comprising the step of cooling the article to a temperature lower than the γ' solvus temperature at a controlled cooling rate immediately after said supersolvus annealing.

15. The method of claim 14, wherein the controlled cooling rate is in the range of about 100–600 F.°/minute.

16. The method of claim 13, wherein the forging preform comprises an extruded billet formed by hot-extruding a pre-alloyed powder comprising the Ni-base superalloy.

17. The method of claim 13, wherein a time for the supersolvus annealing is in the range of about 15 minutes to 5 hours.

18. The method of claim 13 wherein the forged article has a substantially uniform grain size after recrystallization.

19. The method of claim 13, wherein a grain size in the forged article is in the range of about 20 μm or less.

20. The method of claim 13, wherein a grain size of the forging preform is in the range of about 1–50 μm.

21. The method of claim 13, wherein the second temperature is in the range of 0–600 F.° below the γ' solvus temperature of the Ni-base supealloy and the second strain rate is 0.01 $s^{-1}$ or greater.

22. A method of forging articles having location specific grain size ranges from a Ni-base superalloy, comprising the sequence of the steps of:

selecting a forging preform formed from a Ni-base superalloy and having a microstructure comprising a mixture of γ and γ' phases, wherein the γ' phase occupies at least 40% by volume of the Ni-base superalloy;

forging the forging preform at a first temperature in the range of about 0–100 F.° below a g' solvus temperature $T_S$ of the Ni-base superalloy and at a first strain rate of 0.01 $s^{-1}$ or less for a first time sufficient to superplastically form the forging preform into a forged article;

forging the forged article at a second temperature and a second strain rate for a second time sufficient to re-form the forged article and store a minimum amount of retained strain energy per unit of volume throughout the forged article, wherein a minimum amount of retained strain energy per unit of volume is stored during the forging steps;

wherein the minimum amount of retained strain energy per unit of volume stored in the forged article during forging is equivalent to the strain energy per unit of volume that would be stored in the Ni-base superalloy compressed to about a 6% reduction in height or more at room temperature; and annealing the article at a temperature $T_A$ in the range $(T_S-100) \leqq T_A \leqq (T_S+100)$, where $T_A$ and $T_S$ are in Fahrenheit degrees, for a time sufficient to ensure that substantially all of the forged article is raised to the annealing temperature, wherein the minimum amount of retained strain energy per unit of volume stored during forging is sufficient to promote recrystallization throughout the forged article during said annealing.

23. A method of forging an article having a controlled grain size ranges from a Ni-base superalloy, comprising the sequence of the steps of:

selecting a forging preform formed from a Ni-base superalloy and having a microstructure comprising a mixture of γ and γ' phases, wherein the γ' phase occupies at least 40% by volume of the Ni-base superalloy;

forging the forging preform at a first subsolvus temperature in the range of about 0–100 F.° below a γ' solvus temperature $T_S$ of the Ni-base superalloy at a first strain rate of 0.01 $s^{-1}$ or less for a first time sufficient to superplastically form the forging preform into a forged article, wherein during forging a minimum amount of retained strain energy per unit of volume is stored, where the forging at a first subsolvus temperature is superplastic forging;

forging the forged article at a second subsolvus temperature and a second strain rate for a second time sufficient to re-form the forged article and store a minimum amount of retained strain energy per unit of volume throughout the forged article; and annealing the article at an annealing temperature $T_A$ in the range $(T_S-100) \leqq T_A \leqq (T_S+100)$, where $T_A$ and $T_S$ are in Fahrenheit degrees, for a time sufficient to ensure that substantially all of the forged article is raised to the annealing temperature, wherein the minimum amount of retained strain energy per unit of volume stored during forging is sufficient to promote recrystallization throughout the forged article during said annealing.

24. A method of forging an article having a controlled grain size ranges from a Ni-base superalloy, comprising the sequence of the steps of:

selecting a forging preform formed from a Ni-base superalloy and having a microstructure comprising a mixture of γ and γ' phases, wherein the g' phase occupies at least 40% by volume of the Ni-base superalloy;

forging the forging preform at a first subsolvus temperature in the range of about 0–100 F.° below a γ' solvus temperature $T_S$ of the Ni-base superalloy at a first strain rate of 0.01 $s^{-1}$ or less for a first time sufficient to superplastically form the forging preform into a forged article, where the forging at a first subsolvus temperature is superplastic forging;

forging the forged article at a second temperature and a second strain rate for a second time sufficient to re-form the forged article and store a minimum amount of retained strain energy per unit of volume throughout the forged article, wherein a minimum amount of retained strain energy per unit of volume is stored during the forging steps;

subsolvus annealing the article after the step of forging at a subsolvus temperature in the range of about 0–100 F.° below the solvus temperature for a time sufficient to ensure that substantially all of the forged article is at the subsolvus temperature; and supersolvus annealing the article at a supersolvus temperature in the range of about 0–100 F.° above the solvus temperature for a time sufficient to ensure that substantially all of the forged article is raised to the annealing supersolvus temperature, wherein the minimum amount of retained strain energy per unit of volume stored during forging is sufficient to promote recrystallization throughout the forged article upon supersolvus annealing.

25. A method of forging articles having location specific grain size ranges from a Ni-base superalloy, comprising the sequence of the steps of:

selecting a forging preform formed from a Ni-base superalloy and having a microstructure comprising a mixture of γ and γ' phases, wherein the γ' phase occupies at least 40% by volume of the Ni-base superalloy;

forging the forging preform at a first temperature in the range of about 0–100 F.° below a γ' solvus temperature $T_S$ of the Ni-base superalloy and at a first strain rate of 0.01 $s^{-1}$ or less for a first time sufficient to superplastically form the forging preform into a forged article, where the forging at a first subsolvus temperature is superplastic forging;

forging the forged article at a second temperature and a second strain rate for a second time sufficient to re-form the forged article and store a minimum amount of retained strain energy per unit of volume throughout the forged article, wherein a minimum amount of retained strain energy per unit of volume is stored during the forging steps;

wherein the minimum amount of retained strain energy per unit of volume stored in the forged article during forging is equivalent to the strain energy per unit of volume that would be stored in the Ni-base superalloy compressed to about a 6% reduction in height or more at room temperature; and annealing the article at a temperature $T_A$ in the range $(T_S-100) \leqq T_A \leqq (T_S+100)$, where $T_A$ and $T_S$ are in Fahrenheit degrees, for a time sufficient to ensure that substantially all of the forged article is raised to the annealing temperature, wherein the minimum amount of retained strain energy per unit of volume stored during forging is sufficient to promote recrystallization throughout the forged article during said annealing.

26. A method of forging an article having a controlled grain size ranges from a Ni-base superalloy, comprising the sequence of the steps of:

selecting a forging preform formed from a Ni-base superalloy and having a microstructure comprising a mixture of γ and γ' phases, wherein the g' phase occupies at least 40% by volume of the Ni-base superalloy;

forging the forging preform at a first subsolvus temperature in the range of about 0–100 F.° below a γ' solvus temperature $T_S$ of the Ni-base superalloy at a first strain rate of 0.01 $s^{-1}$ or less for a first time sufficient to superplastically form the forging preform into a forged article, wherein during the forging at the first subsolvus temperature a minimum amount of retained strain energy per unit of volume is stored;

forging the forged article at a second subsolvus temperature and a second strain rate for a second time sufficient to re-form the forged article and store a minimum amount of retained strain energy per unit of volume throughout the forged article, wherein there is no heat treatment between the forging at a first subsolvus temperature and the forging at a second subsolvus temperature; and annealing the article at an annealing temperature $T_A$ in the range $(T_S-100) \leqq T_A \leqq (T_S+100)$, where $T_A$ and $T_S$ are in Fahrenheit degrees, for a time sufficient to ensure that substantially all of the forged article is raised to the annealing temperature, wherein the minimum amount of retained strain energy per unit of volume stored during forging is sufficient to promote recrystallization throughout the forged article during said annealing.

27. A method of forging an article having a controlled grain size from a Ni-base superalloy, comprising the sequence of the steps of:

selecting a forging preform formed from a Ni-base superalloy and having a microstructure comprising a mixture of γ and γ' phases, wherein the γ' phase occupies at least 40% by volume of the Ni-base superalloy;

forging the forging preform at a first subsolvus temperature in the range of about 0–100 F.° below aγ' solvus temperature $T_S$ of the Ni-base superalloy at a first strain rate of 0.01 $s^{-1}$ or less for a first time sufficient to superplastically form the forging preform into a forged article;

forging the forged article at a second temperature and a second strain rate for a second time sufficient to re-form the forged article and store a minimum amount of retained strain energy per unit of volume throughout the forged article, wherein a minimum amount of retained strain energy per unit of volume is stored during the forging steps, wherein there is no heat treatment between the forging at a first subsolvus temperature and the forging at a second subsolvus temperature;

subsolvus annealing the article after the step of forging at an annealing subsolvus temperature in the range of about 0–100 F.° below the solvus temperature for a time sufficient to ensure that substantially all of the forged article is at the subsolvus temperature; and supersolvus annealing the article at a supersolvus temperature in the range of about 0–100 F.° above the solvus temperature for a time sufficient to ensure that substantially all of the forged article is raised to the supersolvus temperature, wherein the minimum amount of retained strain energy per unit of volume stored during forging is sufficient to promote recrystallization throughout the forged article upon supersolvus annealing.

28. A method of forging articles having location specific grain size ranges from a Ni-base superalloy, comprising the sequence of the steps of:

selecting a forging preform formed from a Ni-base superalloy and having a microstructure comprising a mixture of γ and γ' phases, wherein the γ' phase occupies at least 40% by volume of the Ni-base superalloy;

forging the forging preform at a first temperature in the range of about 0–100 F.° below a γ' solvus temperature $T_S$ of the Ni-base superalloy and at a first strain rate of 0.01 $s^{-1}$ or less for a first time sufficient to superplastically form the forging preform into a forged article;

forging the forged article at a second temperature and a second strain rate for a second time sufficient to re-form the forged article and store a minimum amount of retained strain energy per unit of volume throughout the forged article, wherein a minimum amount of retained strain energy per unit of volume is stored during the forging steps, wherein there is no heat treatment between the forging at a first subsolvus temperature and the forging at a second subsolvus temperature;

wherein the minimum amount of retained strain energy per unit of volume stored in the forged article during forging is equivalent to the strain energy per unit of volume that would be stored in the Ni-base superalloy compressed to about a 6% reduction in height or more at room temperature; and annealing the article at a temperature $T_A$ in the range $(T_S-100) \leqq T_A \leqq (T_S+100)$, where $T_A$ and $T_S$ are in Fahrenheit degrees, for a time sufficient to ensure that substantially all of the forged article is raised to the annealing temperature, wherein the minimum amount of retained strain energy per unit of volume stored during forging is sufficient to promote recrystallization throughout the forged article during said annealing.

* * * * *